US005853436A

United States Patent [19]

Cherpeck

[11] Patent Number: 5,853,436

[45] Date of Patent: Dec. 29, 1998

[54] DIESEL FUEL COMPOSITION CONTAINING THE SALT OF AN ALKYL HYDROXYAROMATIC COMPOUND AND AN ALIPHATIC AMINE

[75] Inventor: Richard E. Cherpeck, Cotati, Calif.

[73] Assignee: Chevron Chemical Company LLC, San Francisco, Calif.

[21] Appl. No.: 995,594

[22] Filed: Dec. 22, 1997

[51] Int. Cl.[6] ..... C10L 1/22

[52] U.S. Cl. ..... 44/412

[58] Field of Search ..... 44/412, 424, 434

[56] References Cited

U.S. PATENT DOCUMENTS

| | | | |
|---|---|---|---|
| 2,053,466 | 9/1936 | Downing | 44/412 |
| 2,771,368 | 11/1956 | Thompson | 44/424 |
| 2,796,336 | 6/1957 | Bradley | 44/424 |
| 3,250,713 | 5/1966 | Reinis | 44/412 |
| 5,192,335 | 3/1993 | Cherpeck | 44/387 |

FOREIGN PATENT DOCUMENTS

| | | | |
|---|---|---|---|
| 94/14929 | 7/1994 | WIPO | C10L 1/18 |
| 94/17160 | 8/1994 | WIPO | C10L 1/18 |
| 96/18706 | 6/1996 | WIPO | C10L 1/14 |
| 96/18708 | 6/1996 | WIPO | C10L 1/18 |
| 96/23855 | 8/1996 | WIPO | C10L 1/14 |

*Primary Examiner*—Margaret B. Medley
*Attorney, Agent, or Firm*—Claude J. Caroli

[57] ABSTRACT

A diesel fuel composition comprising a major amount of hydrocarbons boiling in the diesel range and an effective lubricity enhancing amount of a salt of an alkyl hydroxyaromatic compound and an aliphatic amine, wherein the salt has the formula:

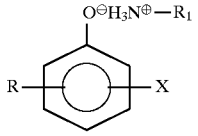

wherein R is alkyl of 6 to 25 carbon atoms; $R_1$ is alkyl or alkenyl of 6 to 50 carbon atoms; and X is hydrogen, hydroxy or the group $—O^-H_3N^+—R_2$, wherein $R_2$ is alkyl or alkenyl of 6 to 50 carbon atoms.

28 Claims, No Drawings

DIESEL FUEL COMPOSITION CONTAINING THE SALT OF AN ALKYL HYDROXYAROMATIC COMPOUND AND AN ALIPHATIC AMINE

BACKGROUND OF THE INVENTION

1. Field of The Invention

The present invention relates to a diesel fuel composition that is effective in increasing the lubricity of the diesel fuel, and reducing wear on the fuel injection pump in a compression ignition diesel engine.

2. Description of The Related Art

Recently, since considerable attention is being paid to global environmental issues, various countries have been concerned with enhancement of regulations on exhaust gas produced by diesel engine cars and reduction of sulfur content of diesel fuel. Most such regulations have set a target to reduce the sulfur content of diesel fuel to less than 0.05 weight %.

The reduction of sulfur content in diesel fuel has occurred in the United States and European countries. In these countries, it has been reported that the reduction of sulfur content may cause abnormal wear of the fuel injection pump, and troublesome engine operations. These problems are considered to be caused by a decrease of lubricity of the diesel fuel of low sulfur content. The decrease of lubricity of the diesel fuel is thought to be caused by removal of lubricants of natural origin when the diesel fuel is desulfurized in the hydrogenating desulfurization process.

Accordingly, it is desirable to provide a diesel fuel additive which is able to give to the diesel fuel of low sulfur content an-anti wear property and an improved lubricity property commensurate with that observed in the use of conventionally employed diesel fuels. The improvement of anti-wear and lubricity properties is also of value for diesel fuels not sufficiently desulfurized.

PCT Publication No. WO 96/18706 discloses a diesel fuel composition having a sulfur content of at most 0.2% by weight which contains a minor proportion of a lubricity enhancer, such as the ester of a polyhydric alcohol, in combination with at least one nitrogen compound having one or more substituents of the formula>NR, wherein R is a hydrocarbyl group of 8 to 40 carbon atoms. This publication further discloses that the nitrogen compound may be an amine salt and/or amide formed by reacting at least one molar proportion of a hydrocarbyl-substituted amine and a molar proportion of a hydrocarbyl acid having from 1 to 4 carboxylic acid groups or its anhydride.

PCT Publication No. WO 96/23855 discloses a diesel fuel composition containing not more than 0.05% by weight of sulfur and a minor amount of an additive composition comprising (a) an ashless dispersant comprising an acylated nitrogen compound, and (b) a carboxylic acid or an ester of the carboxylic acid and an alcohol wherein the acid has from 2 to 50 carbon atoms and the alcohol has one or more carbon atoms.

PCT Publication No. WO 96/18708 discloses a diesel fuel composition having a sulfur content of at most 0.2% by weight which contains minor proportions of a lubricity enhancer, such as the ester of a polyhydric alcohol and a carboxylic acid, and at least one ethylene-unsaturated ester copolymer.

PCT Publication No. WO 94/17160 discloses a diesel fuel composition having a sulfur concentration of 0.2% by weight or less and a minor proportion of an additive comprising an ester of a carboxylic acid and an alcohol, wherein the acid has from 2 to 50 carbon atoms and the alcohol has one or more carbon atoms.

U.S. Pat. No. 5,192,335 issued Mar. 9,1993 to Cherpeck discloses a fuel composition comprising a major amount of hydrocarbons boiling in the gasoline or diesel range and a detergent additive containing (a) a poly(oxyalkylene) amine, and (b) a polyalkyl hydroxaromatic compound or salt thereof, wherein the polyalkyl group has an average molecular weight of about 400 to 5,000.

Likewise, PCT Publication No. WO 94/14929 discloses a fuel composition comprising a major amount of hydrocarbons boiling in the gasoline or diesel range and a detergent additive containing (a) a fuel-soluble aliphatic amine, and (b) a polyalkyl hydroxyaromatic compound or salt thereof, wherein the polyalkyl group has an average molecular weight of about 400 to 5,000.

SUMMARY OF THE INVENTION

The present invention provides a diesel fuel composition that is effective in increasing the lubricity of the diesel fuel and reducing wear on the fuel injection pump in a compression ignition diesel engine.

Accordingly, the present invention provides a novel diesel fuel composition comprising a major amount of hydrocarbons boiling in the diesel range and an effective lubricity enhancing amount of a salt of an alkyl hydroxyaromatic compound and an aliphatic amine, wherein the salt has the formula:

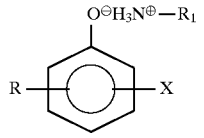

(I)

wherein R is alkyl of 6 to 25 carbon atoms; $R_1$ is alkyl or alkenyl of 6 to 50 carbon atoms; and X is hydrogen, hydroxy or the group $—O^-H_3N^+—R_2$, wherein $R_2$ is alkyl or alkenyl of 6 to 50 carbon atoms.

Preferably, R is alkyl of 6 to 20 carbon atoms, more preferably, 8 to 18 carbon atoms. It is also preferred that $R_1$ and $R_2$ are independently alkyl or alkenyl of 6 to 30 carbon atoms, more preferably, 8 to 20 carbon atoms. In addition, X is preferably hydrogen.

The present invention further provides a method for reducing the wear rate in the injection system of a compression ignition diesel engine which comprises operating the engine with the novel diesel fuel composition of the present invention.

Preferably, the fuel composition of the present invention will contain a diesel fuel having a sulfur concentration of 0.2 weight % or less, more preferably, 0.1 weight % or less, and most preferably, 0.05 weight % or less.

Among other factors, the present invention is based on the surprising discovery that the salt of an alkyl hydroxyaromatic compound and an aliphatic amine, when employed as a fuel additive in diesel fuels, particularly diesel fuels having a low sulfur content, is highly effective in enhancing the lubricity of the diesel fuel and reducing wear in the injection system, especially on the fuel injection pump, of the diesel engine.

DETAILED DESCRIPTION OF THE INVENTION

As noted above, the diesel fuel composition of the present invention contains a lubricity additive which is the salt of an alkyl hydroxyaromatic compound and an aliphatic amine. These compounds are described in further detail below.

The Alkyl Hydroxyaromatic Compound

The alkyl hydroxyaromatic compound employed in the present invention can be represented by the following formula:

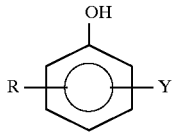

(II)

wherein R is an alkyl group of 6 to 25 carbon atoms and Y is hydrogen or hydroxy. Preferably R is an alkyl group of 6 to 20 carbon atoms, more preferably, alkyl of 8 to 18 carbon atoms. The alkyl group, R, may be straight or branched-chain. An especially preferred alkyl group is a straight or branched-chain alkyl of 12 carbon atoms. One such preferred alkyl is a branched-chain alkyl derived from propylene tetramer and commonly referred to as tetrapropenyl.

The alkyl hydroxyaromatic compound of Formula II may contain one or two hydroxy groups. Suitable alkyl hydroxyaromatic compounds include alkyl phenol, alkyl catechol and alkyl resorcinol. Preferably, the alkyl group will be para to the hydroxy group on the aromatic ring. If two hydroxy groups are present, the alkyl group is preferably para to one hydroxy group and meta to the other. The preferred alkyl hydroxyaromatic compound is alkyl phenol, especially tetrapropenyl phenol.

The Aliphatic Amine

The aliphatic amine employed in the present invention is an alkyl or alkenyl monoamine, that is, a primary amine, wherein the alkyl or alkenyl group contains from 6 to 50 carbon atoms. The aliphatic amine may be represented by the formula $H_2N—R_1$, wherein $R_1$ is an alkyl or alkenyl group of 6 to 50 carbon atoms. Preferably, the alkyl or alkenyl group will contain from 6 to 30 carbon atoms, more preferably, from 8 to 20 carbon atoms.

The alkyl or alkenyl group on the aliphatic amine may be straight or branched chain. Typical straight chain aliphatic amines include hexyamine, octylamine, decylamine, dodecylamine, myristyl amine, oleyl amine, stearyl amine and linoleyl amine.

The alkyl or alkenyl amine may also be branched chain. Suitable branched chain aliphatic amines include the tertiary alkyl amines, such as tertiary octyl amine, which are commercially available under the "Primene" trade name from Rohm & Haas.

A preferred aliphatic amine is oleyl amine.

The lubricity additive employed in the present invention may be readily obtained by mixing the alkyl hydroxyaromatic compound with the aliphatic amine to form the desired salt of the alkyl hydroxyaromatic compound and aliphatic amine. The reaction may generally be carried out at a temperature of from 0° C. to 100° C., preferably from room temperature, or about 20° C., to about 50° C. The reaction may be carried out with or without a solvent, such as toluene or xylene. When the alkyl hydroxyaromatic compound contains two hydroxy groups, both the mono and bis salts can be obtained. Mixed salts of dihydroxyaromatic compounds are also contemplated for use in the present invention.

The ratio of amount of the aliphatic amine to the hydroxyaromatic compound in the diesel fuel lubricity additive employed in the present invention may be varied from 0.9 to 1.5 equivalents of aliphatic amine to one equivalent of the hydroxyaromatic compound. The diesel fuel lubricity additive may contain unreacted or unneutralized hydroxaromatic compound or aliphatic amine within the range. If the hydroxyaromatic compound contains two hydroxy groups, then from 0.9 to 2.5 equivalents of aliphatic amine to one equivalent of hydroxyaromatic compound may be employed.

Fuel Compositions

The fuel additive employed in the present invention will generally be employed in a hydrocarbon distillate fuel boiling in the diesel range. The proper concentration of this additive necessary in order to achieve the desired lubricity and anti-wear properties varies depending upon the type of fuel employed, the type of engine, and the presence of other fuel additives. Generally, however, from about 10 ppm to about 1 weight % (10,000 ppm), preferably from about 20 to 2,000 ppm and, more preferably, from about 30 to 300 ppm, of the present additive per part of base fuel is needed to achieve the best results.

The diesel fuel additive employed in the invention may be formulated as a concentrate, using an inert stable oleophilic (i.e., dissolves in diesel fuel) organic solvent boiling in the range of about 150° F. to 400° F. (about 65° C. to 205° C.). Preferably, an aliphatic or an aromatic hydrocarbon solvent is used, such as benzene, toluene, xylene or higher-boiling aromatics or aromatic thinners. Aliphatic alcohols of about 3 to 8 carbon atoms, such as isopropanol, isobutylcarbinol, n-butanol and the like, in combination with hydrocarbon solvents are also suitable for use with the lubricity additive. In the concentrate, the amount of the presently employed additive composition will be ordinarily at least 10% by weight and generally not exceed 70% by weight, preferably 10 to 50 weight %, and more preferably from 20 to 40 weight %.

There are no specific limitations with respect to the diesel fuel employed in the present invention. However, the invention preferably employs a diesel fuel having a sulfur content of not more than 0.2 weight %, more preferably, not more than 0.1 weight %, and particularly not more than 0.05 weight %.

The diesel fuel additive employed in the invention can be produced by blending other diesel fuel additives such as detergent/dispersants, low temperature pour point depressants, cetane improvers, flow improvers, antioxidants, metal deactivators, rust inhibitors, corrosion inhibitors, demulsifiers and foam inhibitors, in the conventionally adopted amounts. The diesel fuel additive produced by that method might have a slightly different composition than the starting materials, as components interact.

EXAMPLES

The invention will be further illustrated by the following examples, which set forth particularly advantageous specific embodiments. While the Examples are provided to illustrate the present invention, they are not intended to limit it.

PREPARATION OF DIESEL FUEL COMPOSITION

1) Diesel fuel

2) The diesel fuel employed had the following characteristics:

TABLE 1

| | Diesel fuel |
|---|---|
| Aromatics (wt. %) | <5 |
| Sulfur content (ppm) | <6 |

TABLE 1-continued

| | Diesel fuel |
|---|---|
| Distillation test (°C.) | |
| Initial boiling | 153 |
| 50% distillation | 288 |
| 90% distillation | 323 |
| End point | 349 |
| Viscosity (cSt, 40° C.) | 3.95 |

2) Diesel fuel additives

The following diesel fuel additives were prepared:

Additive 1: A salt of tetrapropenylphenol and oleylamine in neutralizing equivalent amounts.

Comparative Additive A: Tetrapropenyl phenol.

Comparative Additive B: Oleylamine.

3) Preparation of diesel fuel compositions

The above-mentioned diesel fuel additives were incorporated into the aforementioned diesel fuel to give the following diesel fuel compositions at a concentration of 200 parts per million of additive:

| Example | Additive ppm | Additive Used |
|---|---|---|
| 1 | 200 | Additive 1 |
| Comp. A | 200 | Comparative Additive A |
| Comp. B | 200 | Comparative Additive B |

EVALUATION OF LUBRICITY

The diesel fuel compositions prepared as above were evaluated for their lubricity characteristics by the following HFRR test.

1) HFRR test

The Coordinating European Council has adopted the HFRR Test (High Frequency Reciprocating Rig Test) in CEC F 06 T 94 as a standard for evaluating lubricity and anti wear characteristics of diesel fuels and diesel fuel additives which are designed to reduce wear of the fuel injection pump of diesel engines due to poor lubricity of the diesel fuel.

According to the HFRR test, a test piece is mounted on an electromagnetic vibrator which vibrates within a small amplitude. This test piece is pushed against another test piece which is fixed at its bottom portion. The friction and a diameter of wear area are then measured. The test temperature, frequency, amplitude of the vibration, and weight are optionally varied.

The evaluation of the diesel fuel additive employed in the present invention was performed according to the method stipulated in CEC F 06 T 94. The test temperature was 60° C. The results are shown in Table 2.

TABLE 2

| Test Sample | ppm Additive | Additive Used | HFRR Test Result (60° C.) Wear Diameter (mm) |
|---|---|---|---|
| No Additive | | | 0.56 (control) |
| 1 | 200 | Additive 1 | 0.39 |
| Comp. A | 200 | Comparative Additive A | 0.53 |
| Comp. B | 200 | Comparative Additive B | 0.44 |

The results set forth in Table 2 demonstrate that the fuel composition containing Additive 1 gives reduced wear size and improved anti-wear characteristics, compared to comparative additives A and B, as well as the unadditized base fuel.

Accordingly, when the diesel fuel additive employed in the present invention is incorporated into a diesel fuel, particularly a diesel fuel containing a reduced amount of sulfur, the additive is highly effective to improve the lubricity of the diesel fuel and reduce wear on the fuel injection pump of the diesel engine.

While the present invention has been described with reference to specific embodiments, this application is intended to cover those various changes and substitutions that may be made by those skilled in the art without departing from the spirit and scope of the appended claims.

What is claimed is:

1. A diesel fuel composition comprising a major amount of hydrocarbons boiling in the diesel range and an effective lubricity enhancing amount of a salt of an alkyl hydroxyaromatic compound and an aliphatic amine, wherein the salt has the formula:

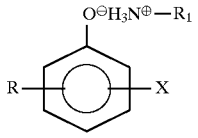

wherein R is alkyl of 6 to 25 carbon atoms; $R_1$ is alkyl or alkenyl of 6 to 50 carbon atoms; and X is hydrogen, hydroxy or the group $—O^-H_3N^+—R_2$, wherein $R_2$ is alkyl or alkenyl of 6 to 50 carbon atoms wherein the diesel fuel composition contains not more than 0.2 weight % of sulfur.

2. The diesel fuel composition according to claim 1, wherein the diesel fuel composition contains not more than 0.1 weight % of sulfur.

3. The diesel fuel composition according to claim 2, wherein the diesel fuel composition contains not more than 0.05 weight % of sulfur.

4. The diesel fuel composition according to claim 1, wherein R is alkyl of 6 to 20 carbon atoms.

5. The diesel fuel composition according to claim 4, wherein R is alkyl of 8 to 18 carbon atoms.

6. The diesel fuel composition according to claim 5, wherein R is a branched chain alkyl of 12 carbon atoms.

7. The diesel fuel composition according to claim 1, wherein $R_1$ is alkyl or alkenyl of 6 to 30 carbon atoms.

8. The diesel fuel composition according to claim 7, wherein $R_1$ is alkyl or alkenyl of 8 to 20 carbon atoms.

9. The diesel fuel composition according to claim 1, wherein X is $—O^-H_3N^+—R_2$.

10. The diesel fuel composition according to claim 9, wherein $R_2$ is alkyl or alkenyl of 6 to 30 carbon atoms.

11. The diesel fuel composition according to claim 10, wherein $R_2$ is alkyl or alkenyl of 8 to 20 carbon atoms.

12. The diesel fuel composition according to claim 1, wherein X is hydrogen.

13. The diesel fuel composition according to claim 1, wherein the alkyl hydroxyaromatic compound is an alkylphenol, wherein the alkyl group is a branched chain alkyl of 12 carbon atoms, and the aliphatic amine is oleyl amine.

14. The diesel fuel composition according to claim 1, wherein the diesel fuel composition contains about 10 parts per million to 1 weight % of the salt of an alkyl hydroxyaromatic compound and an aliphatic amine.

15. A method for reducing the wear rate in the injection system of a compression ignition diesel engine which comprises operating the engine with a diesel fuel composition comprising a major amount of hydrocarbons boiling in the diesel range and an effective lubricity enhancing amount of a salt of an alkyl hydroxyaromatic compound and an aliphatic amine, wherein the salt has the formula:

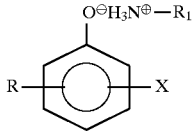

wherein R is alkyl of 6 to 25 carbon atoms; $R_1$ is alkyl or alkenyl of 6 to 50 carbon atoms; and X is hydrogen, hydroxy or the group $—O^-H_3N^+—R_2$, wherein $R_2$ is alkyl or alkenyl of 6 to 50 carbon atoms wherein the diesel fuel composition contains not more than 0.2 weight % of sulfur.

16. The method according to claim 15, wherein the diesel fuel composition contains not more than 0.1 weight % of sulfur.

17. The method according to claim 15, wherein the diesel fuel composition contains not more than 0.05 weight % of sulfur.

18. The method according to claim 15, wherein R is alkyl of 6 to 20 carbon atoms.

19. The method according to claim 18, wherein R is alkyl of 8 to 18 carbon atoms.

20. The method according to claim 19, wherein R is a branched chain alkyl of 12 carbon atoms.

21. The method according to claim 15, wherein $R_1$ is alkyl or alkenyl of 6 to 30 carbon atoms.

22. The method according to claim 21, wherein $R_1$ is alkyl or alkenyl of 8 to 20 carbon atoms.

23. The method according to claim 15, wherein X is $—O^-H_3N^+—R_2$.

24. The method according to claim 23, wherein $R_2$ is alkyl or alkenyl of 6 to 30 carbon atoms.

25. The method according to claim 24, wherein $R_2$ is alkyl or alkenyl of 8 to 20 carbon atoms.

26. The method according to claim 15, wherein X is hydrogen.

27. The method according to claim 15, wherein the alkyl hydroxyaromatic compound is an alkylphenol, wherein the alkyl group is a branched chain alkyl of 12 carbon atoms, and the aliphatic amine is oleyl amine.

28. The method according to claim 15, wherein the diesel fuel composition contains about 10 parts per million to 1 weight % of the salt of an alkyl hydroxyaromatic compound and an aliphatic amine.

* * * * *